US006168555B1

(12) United States Patent
Fetterleigh et al.

(10) Patent No.: US 6,168,555 B1
(45) Date of Patent: Jan. 2, 2001

(54) POGO STICK PROVIDING A DISTINCTIVE INDICATION WHEN OPERATED

(75) Inventors: Dale Michael Fetterleigh, San Bernardino; Karen Gottlieb-Myers, Los Angeles, both of CA (US)

(73) Assignee: Sport Fun, Inc., Los Angeles, CA (US)

( * ) Notice: Under 35 U.S.C. 154(b), the term of this patent shall be extended for 0 days.

(21) Appl. No.: 09/159,291

(22) Filed: Sep. 23, 1998

(51) Int. Cl.[7] ..... A63B 25/08
(52) U.S. Cl. ..... 482/77; 482/908
(58) Field of Search ..... 482/5–9, 77, 908

(56) References Cited

U.S. PATENT DOCUMENTS

| | | | | |
|---|---|---|---|---|
| 2,793,036 | * | 5/1957 | Hansburg | 482/77 |
| 4,390,178 | * | 6/1983 | Rudell et al. | 482/77 |
| 4,526,036 | * | 7/1985 | Morrison | 482/3 |
| 5,857,939 | * | 1/1999 | Kaufman | 482/1 |

* cited by examiner

*Primary Examiner*—Jerome Donnelly
(74) *Attorney, Agent, or Firm*—Fulwider Patton Lee & Utecht, LLP; Ellsworth R. Roston

(57) ABSTRACT

A pogo stick includes (a) a housing, (b) a member movable within the housing, (c) a spring retained at opposite ends by the housing and the member and compressible upon the actuation of the member to a support surface (e.g. ground) and expansible upon the movement of the member from the support surface, (d) a handle on the housing near the housing top and (e) a foot rest on the housing near the housing bottom. A switch normally in an open relationship is operative (a) to a closed relationship upon the actuation of the member to the support surface and (b) to an open relationship upon a movement of the member from the support surface. The switch includes a resilient electrically conductive element and a stationary electrically conductive element normally defining an open relationship. The resilient member is movable in response to the member actuation to the support surface to engage the stationary element and to provide a switch operation in the closed relationship. The resilient element extends beyond a supporting stud for pivotable movement relative to the stud and the stationary element to engage the stationary element upon the member actuation to the support surface. An indicator responsive to the switch operation provides an indication (e.g. distinctive sound) after each particular number of switch operations. The switch and the indicator are disposed within a casing supported by the housing. A reset within the casing is connected to the counter to initialize the count when manually operated.

24 Claims, 5 Drawing Sheets

POGO STICK PROVIDING A DISTINCTIVE INDICATION WHEN OPERATED

This invention relates to a pogo stick and, more particularly, to a pogo stick which provides a distinctive indication (e.g. a distinctive sound) when operated.

BACKGROUND OF THE INVENTION

Pogo sticks have been in existence for some time and provide a distinct challenge to children, particularly to children of advanced age, when operated. To operate a pogo stick, a child steps on a foot rest on a housing on the pogo stick, grasps a handle on the housing and hops through successive iterations to progressive positions until the child loses his or her balance. It is a challenge to a child to be able to hop on the pogo stick through a number of successive iterations without having to jump from the pogo stick because of a loss of balance.

In spite of the challenges offered by the pogo stick, children are constantly looking for new sensations while operating the pogo stick. These new sensations enhance the thrill which the children experience while operating the pogo stick. Such new sensations would be particularly desirable if they provide in some way an instantaneous indication of the number of successive hops experienced by a child during an operation of the pogo stick before the child loses his or her balance.

BRIEF DESCRIPTION OF THE HOUSING

In one embodiment of the invention, a pogo stick includes (a) a housing, (b) a member movable within the housing, (c) a spring retained at opposite ends by the housing and the member and compressible upon the actuation of the member to a support surface (e.g. ground) and expansible upon the movement of the member from the support surface, (d) a handle on the housing near the housing top and (e) a foot rest on the housing near the housing bottom. A switch normally in an open relationship is operative to (a) a closed relationship upon the actuation of the member to the support surface and (b) an open relationship upon a movement of the member from the support surface. The switch includes a resilient electrically conductive element and a stationary electrically conductive element normally defining an open relationship. The resilient member is movable in response to the member actuation to the support surface to engage the stationary element and to provide a switch operation in the closed relationship.

The resilient element extends beyond a supporting stud for pivotable movement relative to the stud and the stationary element to engage the stationary clement upon the member actuation to the support surface. An indicator responsive to the switch operation provides an indication (e.g. distinctive sound) after each particular number of switch operations. The switch and the indicator are disposed within a casing supported by the housing. A reset within the casing is connected to the counter to initialize the count when manually operated.

DETAILED DESCRIPTION OF THE INVENTION

Figure 1:
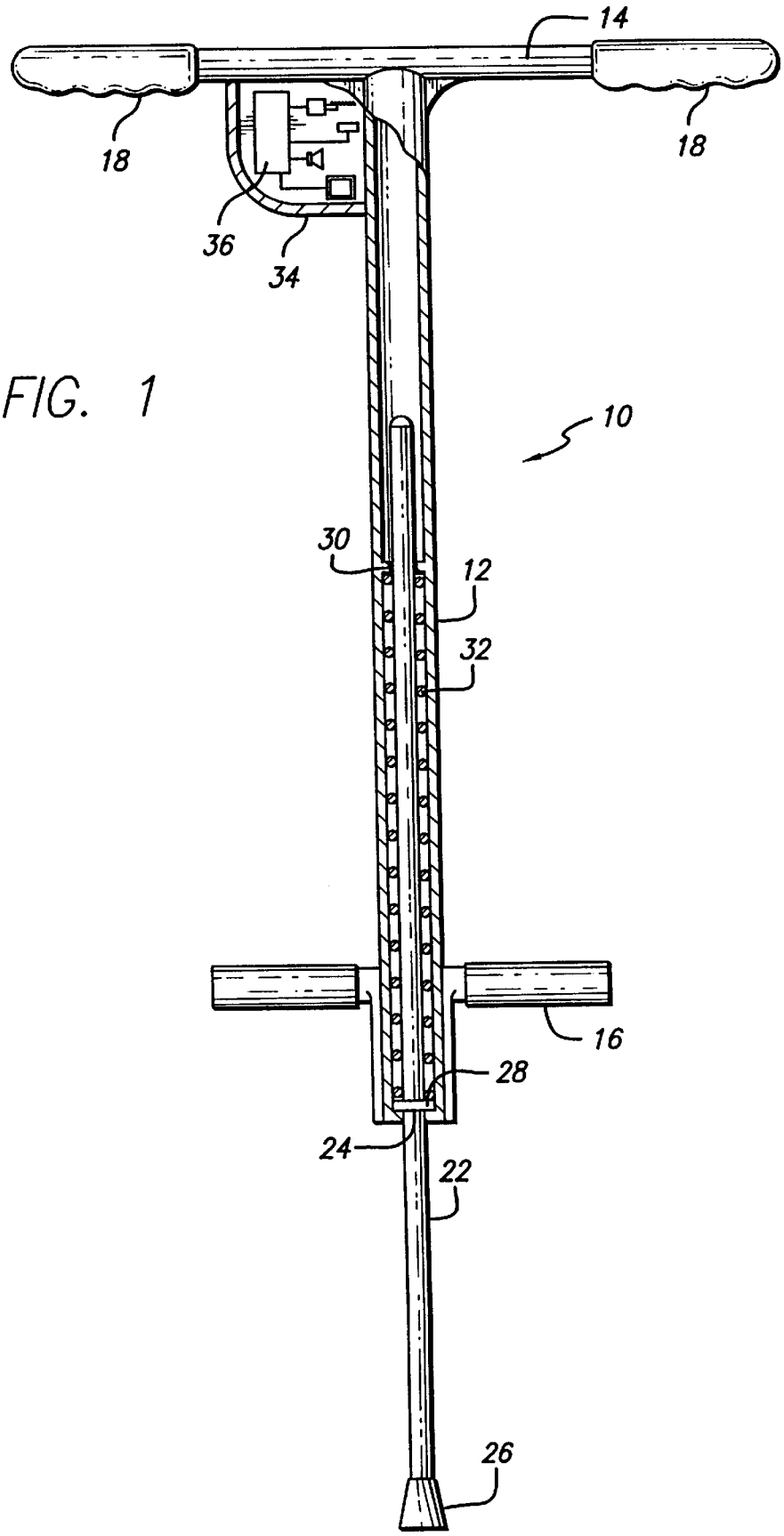
FIG. 1 is a simplified sectional view in elevation of a pogo stick constituting one embodiment of the invention.
Figure 2:
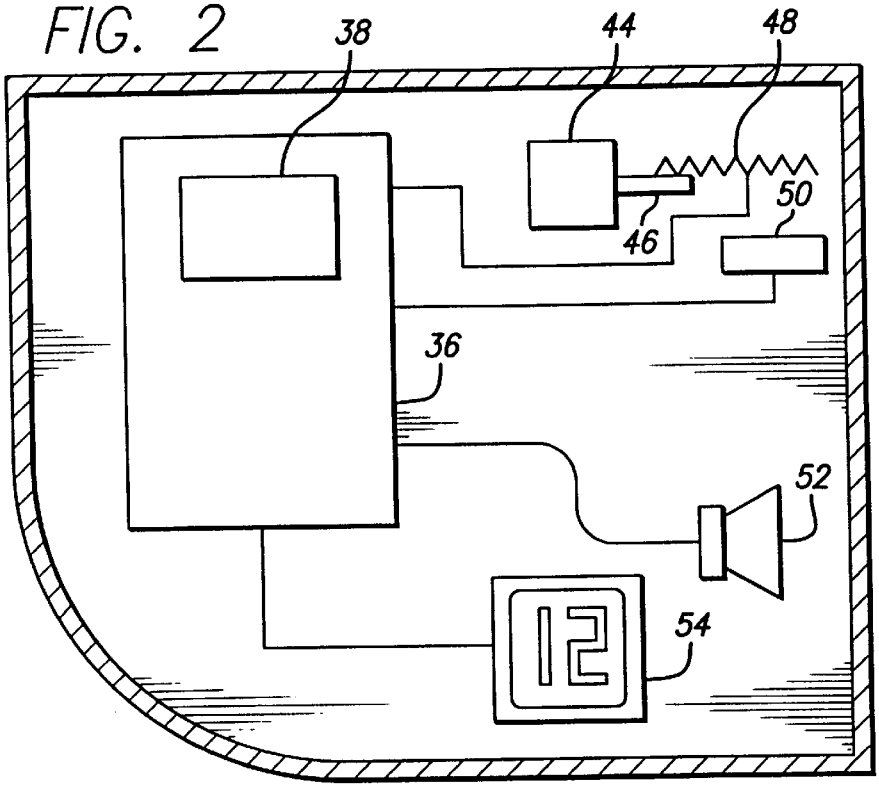
FIG. 2 is an enlarged sectional view in elevation, with the cover removed, of a portion of the pogo stick shown in FIG. 1, this portion being operative to count the number of hops or actuations provided by a child to a support surface (e.g. the ground) before the child loses his or her balance and has to alight from the pogo stick.
Figure 3:
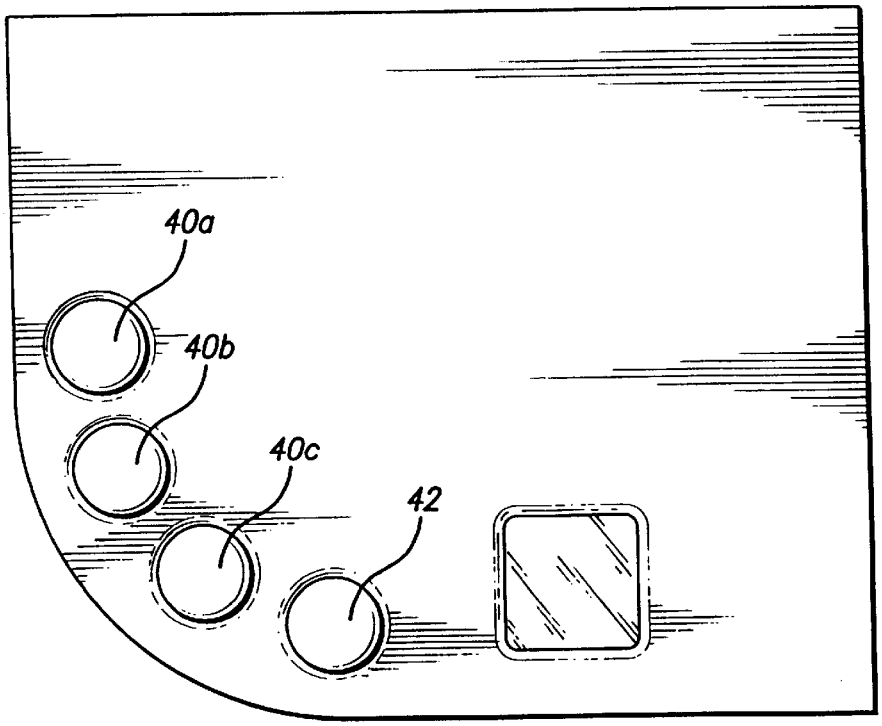
FIG. 3 is an enlarged elevational view of the portion of the pogo stick shown in FIG. 2 with the cover disposed on such portion.

FIGS. 1–3 show a pogo stick, generally indicated at 10, constituting one embodiment of the invention. The pogo stick 10 includes a housing 12 preferably having a hollow tubular form. A handle 14 is disposed at the upper end of the housing and a foot rest or foot stand 16 is disposed on the housing at a position near the lower end of the housing. Covers or handle bars 18 may be provided at the opposite ends of the handle 14 to facilitate a comfortable gripping of the handle by a child on the pogo stick.

An actuating member 22 extends into the housing 12 through an opening 24 at the bottom of the housing. A cover 26 is disposed on the actuating member 22 at the bottom of the actuating member to cushion the impact of the actuating member against the support surface such as the ground. The actuating member 22 has a cap 28 which causes the actuating member to be retained within the housing. An internal flange 30 is disposed in the housing 12 to guide the movement of the actuating member in the housing. A restraining member such as a spring 32, preferably helical, is disposed on the actuating member 22 in the housing 12 between the cap 28 and the internal flange 30.

A casing 34 is supported by the housing 12. The casing 34 may be supported at any suitable position on the housing. In the embodiment shown in FIGS. 1–3, the casing 34 is shown as being disposed at an intersection between the housing 12 and the handle 14. A microprocessor 36 is disposed within the casing 34. The microprocessor 36 includes a counter 38 which is constructed to count to a particular value (e.g. 20) and then recycle for the initiation of a new count. Buttons 40*a*, 40*b* and 40*c* may be disposed on the panel for varying, when depressed, the particular count to individual values (e.g. 10, 20 and 30) before initiating a new count. A button 42 may also be disposed on the casing 34 for providing a reset of the count in the counter 38 to 0, when depressed, before the particular count has been reached.

A support 44 is provided in the casing 34. A support rod 46 extends from the support 44 and holds a resilient electrically conductive member such as a helical spring 48. A portion of the spring 48 extends beyond the support rod 46 for a pivotal movement vertically relative to the rod when the actuating member 22 impinges on the ground. A stationary electrically conductive contact 50 is disposed to engage the spring 48 when the spring is pivoted by the impingement of the actuating member 22 on the ground. The spring 48 and the electrical contact 50 accordingly constitute a switch having open and closed relationships. The spring 48 and the stationary electrical contact 50 are connected to the microprocessor 36.

An indicator such as a speaker 52 is also included in the casing 34 and is connected to the microprocessor 36. It should be appreciated that the indicator may have forms other than the speaker 52 without departing from the scope of the invention. For example, the indicator 52 may provide a visual flash of light every time that the count in the counter 38 reaches the particular value. A liquid crystal display (LCD) 54 may also be included in the casing 34 and may be connected to the microprocessor 36. The LCD 54 may provide a unique display such as a display of musical notes every time that the count in the counter 38 reaches the particular value. Alternatively, the LCD may indicate a congratulatory message such as "good job" every time that the count in the counter 38 reaches the particular value.

A child rests his or her feet on the foot rest or foot stand 16 and grasps the covers or handle bars 18 at the opposite ends of the handle 14. The child then operates the pogo stick 10 to provide progressive hops along the ground. Every time that the actuating member 22 impinges on the ground, the spring 32 becomes constrained to provide energy for the next hop along the ground. The constraint of the spring 32 becomes relieved when the actuating member 22 leaves the ground in the next hop.

Every time that the pogo stick 10 impinges on the ground, the switch formed by the spring 48 and the contact 50 closes. The counter 38 in the microprocessor 36 counts the number of times that the switch closes. When the count in the counter 38 reaches the particular value, the speaker emits a distinctive sound. This sound may provide an aural indication that the child has been successful in hopping the particular number of successive times. If the child has not been successful in hopping the particular number of successive times, the count in the counter 38 can be reset to zero by depressing the button 42.

Figure 5:
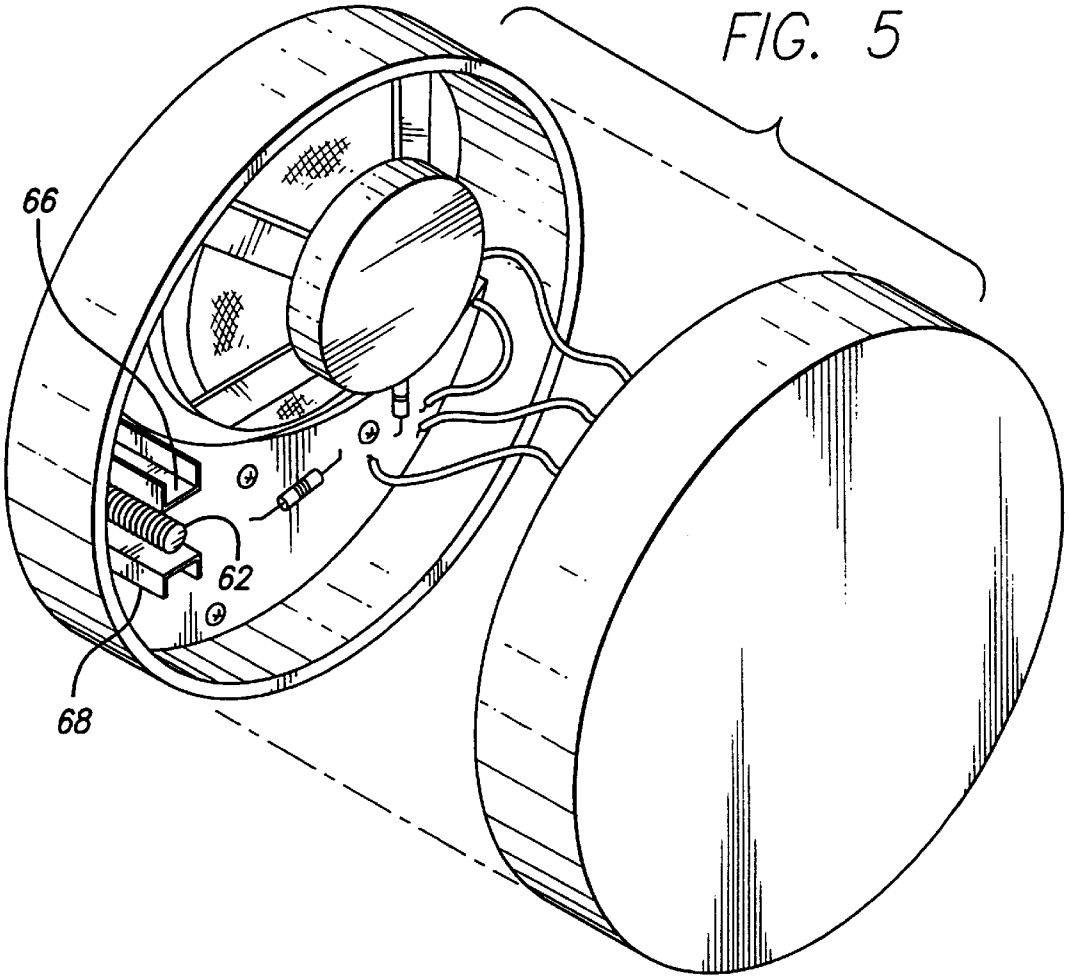
FIG. 5 is an enlarged perspective view, in an open or disassembled relationship, of a portion of a pogo stick shown in FIG. 4 and shows the features which distinguish the embodiment of the invention shown in FIGS. 4 and 5 from the embodiment of the invention shown in FIGS. 1–3.
Figure 4:
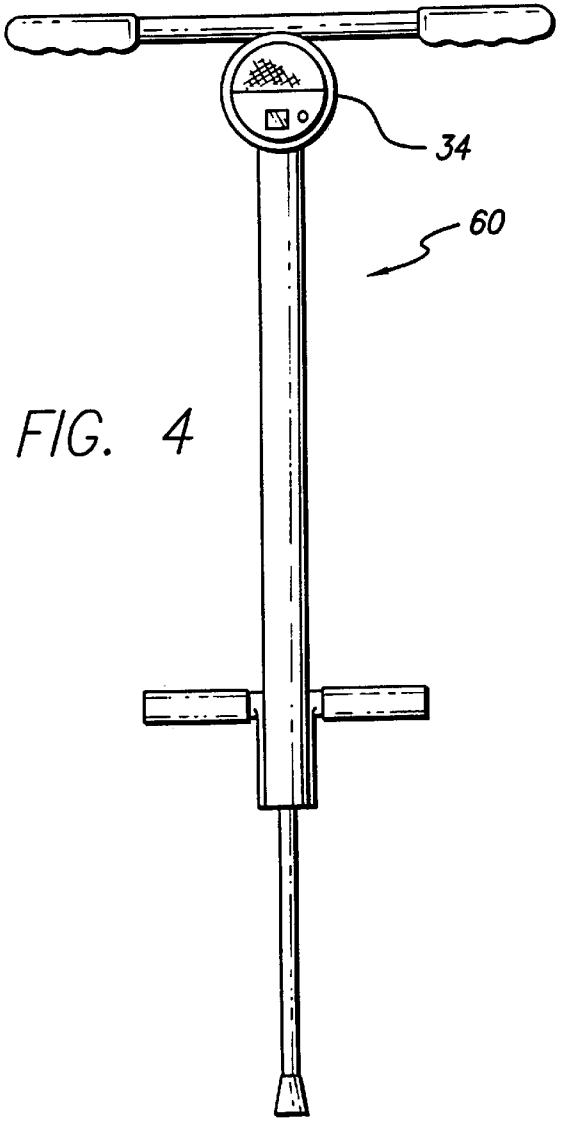
FIG. 4 is a fragmentary sectional view in elevation of a pogo stick constituting a second embodiment of the invention.
Figure 6:
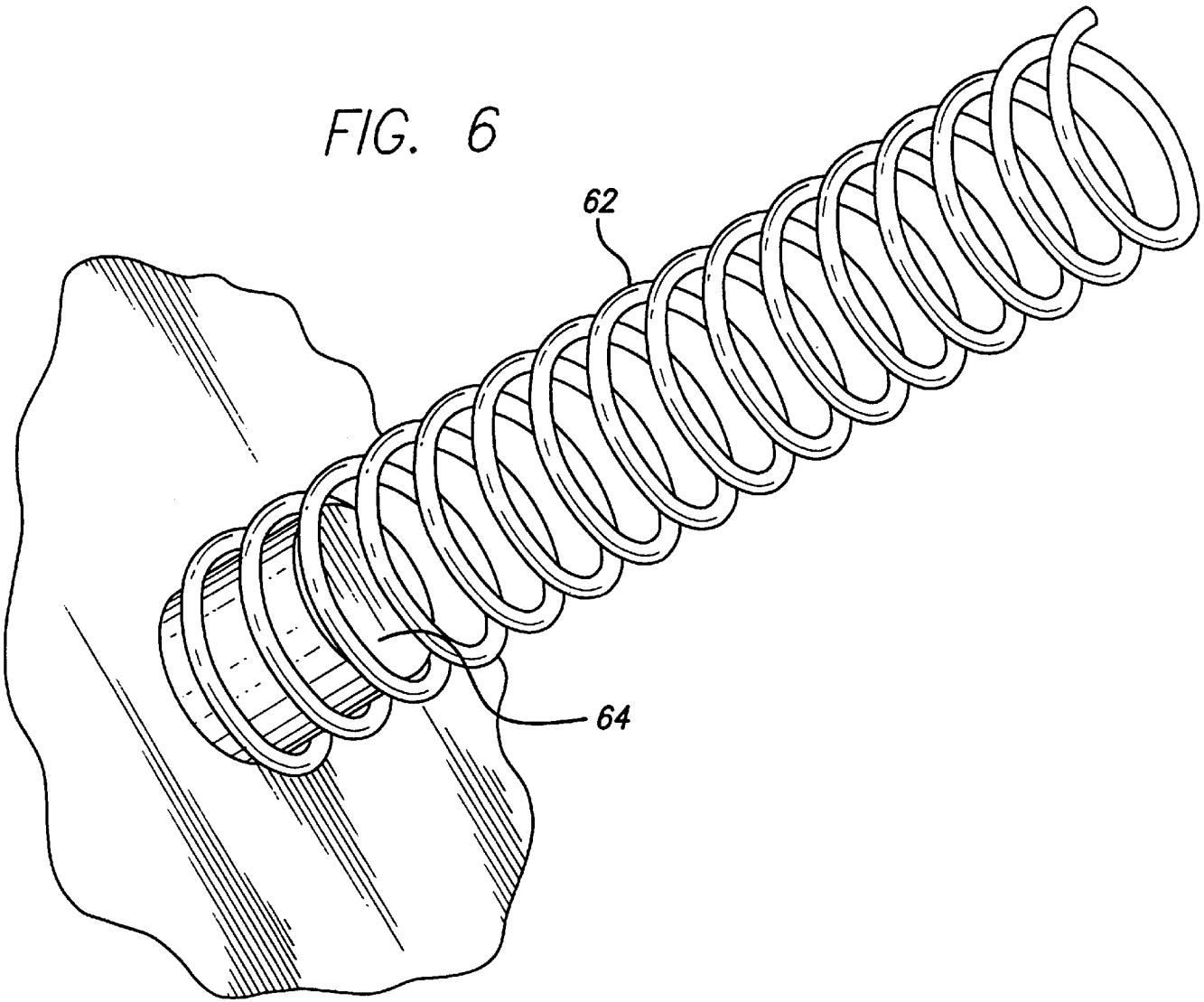
FIG. 6 is a fragmentary sectional view taken substantially on the line 6—6 of FIG. 5 and shows additional details of a switch shown in FIG. 5.

FIGS. 4, 5 and 6 illustrate another embodiment, generally indicated at 60, of the invention. In the embodiment 60, the casing 34 is disposed between the handle 14 and the housing 12. Furthermore, an electrically conductive spring 62 is disposed on a non-conductive stud 64 for pivotal movement vertically into engagement with a stationary electrically conductive contact 66. The spring 62 and the contact 66 accordingly define a switch having open and closed relationships. Another contact 68 is disposed on the other side of the spring 62 from the contact 66 to limit the pivotable movement of the spring in this direction.

Figure 7:
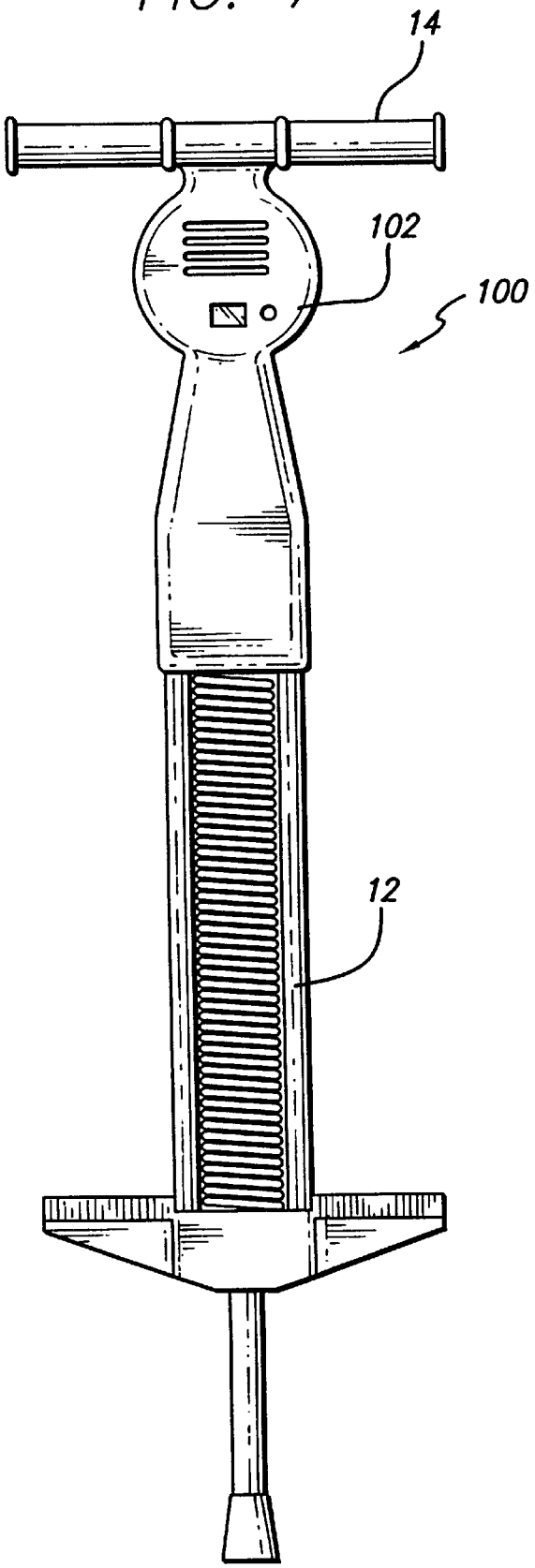
FIG. 7 is an elevational view of a second embodiment, actually constituting a preferred embodiment, of a pogo stick which incorporates the features of the embodiment shown in FIGS. 1–6.

FIG. 7 is an elevational view of a pogo stick generally indicated at 100 and constituting a preferred embodiment of the invention. The embodiment shown in FIG. 7 incorporates all of the features of the embodiment shown in FIGS. 1–6. However, a casing 102 is provided to replace the casing 34. As will be seen, the casing 102 is immediately below the handle 14 and is in aligned relationship with the housing. This facilitates the balance in the pogo stick and facilitates the successful operation of the pogo stick by youngsters. All of the components specified to be included in the casing 34 are included in the casing 102.

Although this invention has been disclosed and illustrated with reference to particular embodiments, the principles involved are capable of being used in numerous other embodiments which will be apparent to persons of ordinary skill in the art. The invention is, therefore, to be limited only as indicated by the scope of the appended claims.

What is claimed is:

1. In combination for use in a pogo stick, a housing, a handle disposed at the top of the housing and defining a balanced relationship with the housing, a foot rest disposed at an intermediate position on the housing and defining a balanced relationship with the housing, an actuator extending into the housing in an aligned relationship with the housing for movement in the housing in accordance with the actuation of the pogo stick onto the ground and the subsequent release of the pogo stick from the ground, a casing disposed between the housing and the handle in an aligned relationship with the housing, a spring disposed in the housing and operatively coupled to the actuator to become constrained upon the actuation of the pogo stick onto the ground and to become released of the constraint upon the release of the pogo stick from the ground, a resilient member disposed in the casing in a first position and responsive to each actuation of the actuator onto the ground to become moved to a second position and responsive to each release of the actuator from the ground to become returned to the first position, a stationary contact disposed in the casing, a switch disposed in the casing and including the resilient member and the stationary contact and having first and second states of operation and operable in the first state with the resilient member in the first position and operable in the second state with the resilient member in the second position, a counter disposed in the casing for counting the number of operations of the resilient member in the second state, and a member disposed in the casing for providing a sensory indication when the count in the counter has reached a particular value.

2. In a combination as set forth in claim 1, the casing being supported on the housing for holding the resilient member, the switch, the stationary contact, the counter and the indicator in the casing, the casing having a balanced relationship with respect to the handle and the housing.

3. In a combination as set forth in claim 1 wherein the indicator provides a distinctive sound upon each count in the counter to the particular value.

4. In a combination as set forth in claim 1 wherein means are included on the casing for setting the counter to count to any desired value to provide the sensory indication by the sensory member.

5. In a combination as set forth in claim 1 wherein the casing is disposed on the housing between the housing and the handle and holds the resilient member, the switch, the counter and the indicator and wherein the indicator provides a distinctive sound upon each count to the particular value.

6. In a combination as set forth in claim 5 wherein a reset is provided on the casing to reset the count in the counter to an initializing value.

7. In combination for use in a pogo stick, a housing operable to provide a bouncing movement along a support surface, a member disposed within the housing in a vertically aligned relationship with the housing and actuatable between a first relationship and a second relationship upon each bouncing movement of the pogo stick on the support surface, a handle supported by the housing in a balanced relationship with the housing;

a casing supported by the housing in a vertically aligned relationship with the housing, a counter disposed within the casing for counting the number of actuations of the member, and an energizable member disposed within the casing and operatively coupled to the counter for providing a sensory indication upon each count by the counter to a particular value.

8. In a combination as set forth in claim 7 wherein the casing has a balanced relationship with the housing.

9. In a combination as set forth in claim 7 wherein the energizable member provides a distinctive sound upon each occurence of a particular mumber of bouncing movements of the member on the support surface.

10. In a combination as set forth in claim 7 wherein a resilient spring is disposed within the casing and is actuatable in a vertical direction upon each engagement of the housing with the support surface and wherein the resilient spring is included in a switch disposed within the casing and having open and closed states and normally operable in the open state and operable in the closed state upon each actuation of the actuatable member and wherein the counter counts the number of times that the switch becomes operative in the closed state.

11. In a combination as set forth in claim 10 wherein the counter is included in a microprocessor which is disposed within the casing and which provides for a count by the counter to the particular value and a resetting of the counter to an initializing value upon each count by the counter to the particular value and an energizing of the energizable member to provide the sensory indication upon each count by the counter to the particular value.

12. In a combination as set forth in claim 11 wherein the energizable member provides a distinctive sound upon each occurrence of a particular number of bouncing movements of the member on the support surface.

13. In a combination as set forth in claim 8 wherein at least one member is disposed on the casing and is manually actuatable to set the counter to one of a plurality of different values.

14. In a combination as set forth in claim 12 wherein at least one member is disposed on the casing and is manually actuatable to set the counter to one of a plurality of different values.

15. In a combination as set forth in claim 8 wherein the casing is disposed between the housing and the handle in contiguous relationship to the handle and is supported by the housing and wherein a reset is provided on the casing for manual operation and is operatively coupled to the counter to reset the counter to an initializing value when manually operated.

16. In combination for use in a pogo stick, a housing disposed in a particular direction, a member movable within the housing in the particular direction, a spring disposed within the housing and retained at opposite ends by the housing and the member and compressible in the particular direction upon the actuation of the member to a support surface and expansible in the particular direction upon the movement of the pogo stick from the support surface, a handle on the housing at a position near the top of the housing, the handle being disposed in a balanced relationship to the housing, a foot rest on the housing at a position near the bottom of the housing, the footrest being disposed in a balanced relationship to the housing, a casing disposed between the handle and the housing in an aligned relationship with the housing, a switch disposed in the casing and having open and closed relationships and normally operable in the open relationship and responsive to the actuation of the housing to the support surface to become operative in the closed relationship and responsive to the movement of the housing from the support surface to become operative in the opened relationship, and an indicator disposed in the casing and responsive to the operations of the switch in the closed relationship to provide a sensory indication after each particular number of operations of the switch in the closed relationship.

17. In a combination as set forth in claim 16 wherein the switch includes a resilient electrically conductive element disposed in the casing and a stationary electrically conductive element disposed in the casing and normally spaced from each other in the particular direction to define the open relationship of the switch and wherein the resilient electrically conductive element is movable in the particular direction in response to the actuation of the housing to the support surface to engage the stationary electrically conductive element in the particular direction and to provide an operation of the switch in the closed relationship.

18. In a combination as set forth in claim 16 wherein the switch includes a resilient electrically conductive element disposed within the housing and a stationary electrically conductive element disposed within the casing and wherein the casing is supported by the housing in a balanced relationship to the housing.

19. In a combination as set forth in claim 16 wherein the casing is disposed between the housing and the handle and is supported by the housing.

20. In a combination as set forth in claim 18 wherein a reset is disposed on the casing for manual operation and wherein a counter is disposed within the casing to count the number of closures of the switch and wherein the reset is connected in the casing to the counter to initialize the count in the counter when the reset is manually operated.

21. In a combination as set forth in claim 17 wherein the resilient electrically conductive element is supported by a stud disposed in the casing and wherein the resilient electrically conductive element extends in the casing beyond the stud for pivotable movement in the particular direction relative to the stud and the stationary electrically conductive element to engage the stationary electrically conductive element upon the actuation of the housing to the support surface.

22. In a combination as set forth in claim 21 wherein the stationary electrically conductive element is displaced in the particular direction in the casing on one side of the resilient electrically conductive element in the casing and wherein another stationary element is displaced in the particular direction in the casing on the other side of the resilient electrically conductive element in the casing to limit the pivotable movement of the resilient electrically conductive element in the particular direction in the casing when the member moves from the support surface.

23. In a combination as set forth in claim 22 wherein the casing is supported by the housing and wherein the indicator provides a distinctive sound when it is energized.

24. In a combination as set forth in claim 23 wherein a reset is disposed on the casing for manual operation and wherein a counter is disposed within the casing to count the number of closures of the switch and wherein the reset is connected in the casing to the counter to initialize the count in the counter when the reset is manually operated.

* * * * *